US011251550B1

(12) United States Patent
Davidsz et al.

(10) Patent No.: US 11,251,550 B1
(45) Date of Patent: Feb. 15, 2022

(54) SYSTEMS AND METHODS FOR A CABLE CONNECTOR

(71) Applicant: ROCKWELL AUTOMATION TECHNOLOGIES, INC., Mayfield Heights, OH (US)

(72) Inventors: Mark E. Davidsz, Oak Creek, WI (US); David D. Brandt, Milwaukee, WI (US); Yutao Wang, Brookfield, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 0 days.

(21) Appl. No.: 17/114,165

(22) Filed: Dec. 7, 2020

(51) Int. Cl.

| | |
|---|---|
| ***H01R 4/24*** | (2018.01) |
| ***H01R 12/67*** | (2011.01) |
| ***H01R 4/2425*** | (2018.01) |
| ***H01R 43/01*** | (2006.01) |
| ***H01R 12/59*** | (2011.01) |
| ***H01R 13/627*** | (2006.01) |
| ***H01R 13/516*** | (2006.01) |
| *H01R 13/58* | (2006.01) |

(52) U.S. Cl.
CPC ..... *H01R 12/675* (2013.01); *H01R 4/2425* (2013.01); *H01R 12/592* (2013.01); *H01R 13/516* (2013.01); *H01R 13/6271* (2013.01); *H01R 43/01* (2013.01); *H01R 13/5833* (2013.01)

(58) Field of Classification Search
CPC ..... H01R 4/2433; H01R 4/2404
USPC ..... 439/417, 409, 492–494
See application file for complete search history.

(56) References Cited

U.S. PATENT DOCUMENTS

| | | | | |
|---|---|---|---|---|
| 4,252,396 | A * | 2/1981 | Wilson | H01R 12/675 439/405 |
| 4,255,009 | A * | 3/1981 | Clark | H01R 4/2462 439/398 |
| 4,655,528 | A * | 4/1987 | Groft | H01R 12/675 439/404 |
| 4,940,430 | A | 7/1990 | Fujitani et al. | |
| 5,059,137 | A * | 10/1991 | Dale | H01R 12/675 439/395 |
| 6,232,557 | B1 * | 5/2001 | Lounsbury | H01B 7/0823 174/117 F |
| 7,007,346 | B2 | 3/2006 | Hoffman | |
| 7,354,310 | B1 | 4/2008 | Brown | |
| 8,723,044 | B2 | 5/2014 | Onodi | |
| 9,698,498 | B1 | 7/2017 | Wang et al. | |

(Continued)

FOREIGN PATENT DOCUMENTS

| | | |
|---|---|---|
| CN | 103140707 A | 6/2013 |
| EP | 1983616 B1 | 10/2015 |

*Primary Examiner* — Phuong Chi Thi Nguyen
(74) *Attorney, Agent, or Firm* — Quarles & Brady LLP

(57) ABSTRACT

A connector for receiving a ribbon cable is provided. The connector includes a housing including an open top, a cable organizer, and a cover. The cable organizer is configured to be positioned within an interior of the housing and configured to receive the ribbon cable upon an upper surface thereof. The cover is configured to selectively cover the open top of the housing to enclose the cable organizer within the interior of the housing. The cover is coupled to the housing and includes a latch configured to engage the housing and the cable organizer and move in a both vertical direction relative to the housing and rotate relative to the housing.

14 Claims, 11 Drawing Sheets

(56) References Cited

U.S. PATENT DOCUMENTS

| | | | |
|---|---|---|---|
| 9,954,296 | B2 | 4/2018 | Haensgen et al. |
| 2006/0183360 | A1 | 8/2006 | Nave et al. |

* cited by examiner

SYSTEMS AND METHODS FOR A CABLE CONNECTOR

CROSS-REFERENCES TO RELATED APPLICATIONS

Not applicable.

STATEMENT REGARDING FEDERALLY SPONSORED RESEARCH

Not Applicable

BACKGROUND INFORMATION

The subject matter disclosed within relates generally to connectors. In particular, the subject matter relates to connectors for ribbon cables such as, but not limited to, those used in conjunction with network transmission media of the type used in industrial control, monitoring, and similar power and data network systems.

BRIEF DESCRIPTION

In one embodiment, a connector for receiving a ribbon cable is provided. The connector includes a housing including an open top, a cable organizer, and a cover. The cable organizer is configured to be positioned within an interior of the housing and configured to receive the ribbon cable upon an upper surface thereof. The cover is configured to selectively cover the open top of the housing to enclose the cable organizer within the interior of the housing. The cover is coupled to the housing and includes a latch configured to engage the housing and the cable organizer and move in a both vertical direction relative to the housing and rotate relative to the housing.

In one embodiment, a method of installing a ribbon cable on a connector is provided. The method includes rotating a cover of the connector away from a housing of the connector by engaging a latch of the cover with a first latch extension of the housing to create a cable access pathway in an open top of the housing. The method also includes positioning the ribbon cable on a cable organizer positioned within the open top of the housing, and rotating the cover back toward the housing until the latch of the cover engages a second latch extension of the cable organizer and the cover is positioned vertically above the cable organizer. The method further includes pressing the cover toward the housing to entrap the ribbon cable within the housing between the cover and the cable organizer.

The foregoing and other aspects and advantages of the present disclosure will appear from the following description. In the description, reference is made to the accompanying drawings which form a part hereof, and in which there is shown by way of illustrations one or more embodiments of the present disclosure. Such embodiments do not necessarily represent the full scope of the present disclosure, however, and reference is made therefore to the claims and herein for interpreting the scope of the present disclosure.

BRIEF DESCRIPTION OF DRAWINGS

The present disclosure will be better understood and features, aspects and advantages other than those set forth above will become apparent when consideration is given to the following detailed description thereof. Such detailed description makes reference to the following drawings.

DETAILED DESCRIPTION

Figure 1:
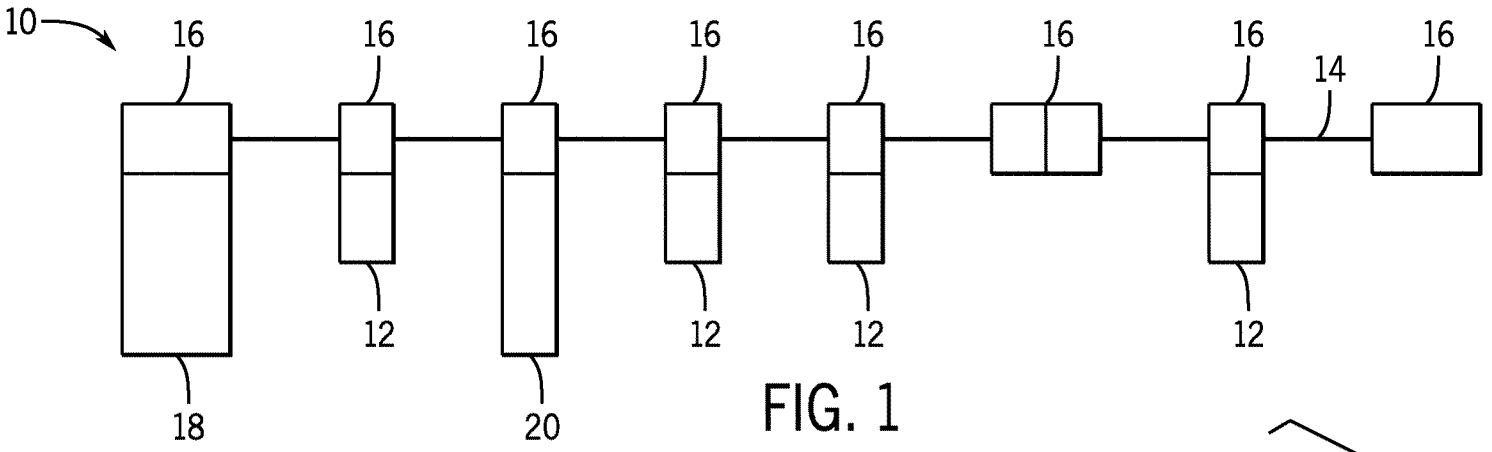
FIG. 1 is a schematic view of a data and power network.

Before any embodiments of the invention are explained in detail, it is to be understood that the embodiments are not limited in its application to the details of construction and the arrangement of components set forth in the following description or illustrated in the following drawings. Aspects of the present disclosure are capable of other embodiments and of being practiced or of being carried out in various ways. Also, it is to be understood that the use the phraseology and terminology used herein is for the purpose of description and should not be regarded as limiting. Furthermore, the use of "right", "left", "front", "back", "upper", "lower", "above", "below", "top", or "bottom" and variations thereof herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the present disclosure. Various modifications to the illustrated embodiments will be readily apparent to those skilled in the art, and the generic principles herein can be applied to other embodiments and applications without departing from embodiments of the present disclosure. Thus, embodiments of the present disclosure are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the present disclosure. Skilled artisans will recognize the examples provided herein have many useful alternatives and fall within the scope of embodiments of the present disclosure.

Disclosed herein is a connector for positioning and locating a flat, ribbon-style cable. The connector may be used in conjunction with such a ribbon cable for use in industrial control, monitoring, and similar power and data network systems, for example, as a node or power connection for a device within the system, passing data and/or power between the ribbon cable and the device, or a termination or splicer for cables within the system. The connectors for various purposes (e.g., power connection, node connection, termination, splicing) can incorporate one or more universal parts, enabling easy assembly of the network with common tooling for all connectors and re-use of certain components for different purposes. Some embodiments of a connector incorporate a cover configured to be coupled to a housing, where the cover is moved along a non-specific trajectory with a combination of translations and rotations, creating a moving axis and extended range of motion of the cover relative to the housing.

By way of example, FIG. 1 schematically illustrates a data and power network 10. The network 10 includes a plurality of device nodes 12 coupled to one another via a network ribbon cable 14. Each device node 12 can receive power and/or data signals from the ribbon cable 14 via a connector 16. More specifically, once coupled to the ribbon cable 14 via a respective connector 16, each device node 12 can transmit and receive control and data signals via the ribbon cable 14 in accordance with various standard protocols in addition to receiving various forms of electrical power. Various examples of device nodes 12 may include, but are not limited to, devices such as push-button switches, motor starters, proximity sensors, flow sensors, speed sensors, actuating solenoids, electrical relays, and electrical contactors.

Additionally, electrical power can be provided to the network 10 via one or more intelligent power taps 18. For example, intelligent power taps 18 can be intelligent devices having the ability to interact with the control and data signals of the network 10, in addition to providing various forms of power. The intelligent power taps 18 can provide power (e.g., in the form of 24 volts DC) to the network 10 by connecting to the ribbon cable 14 via a connector 16. In addition to, or as an alternative to, one or more of the intelligent power taps 18, the network 10 can include one or more non-intelligent power taps 20 connected to the ribbon cable 14 via a connector 16. For example, a non-intelligent power tap 20 may only provide power to the network 10, without interacting with control and data signals. At one or both ends of ribbon cable 14, a connector 16 can further be provided in the form of a terminator for capping the ribbon cable ends and terminating the signal conductors of the ribbon cable 14. Furthermore, within the network 10, one or more connectors 16 can be provided in the form of splicers to electrically connect and cap respective ends of two ribbon cables 14.

Figure 1A:
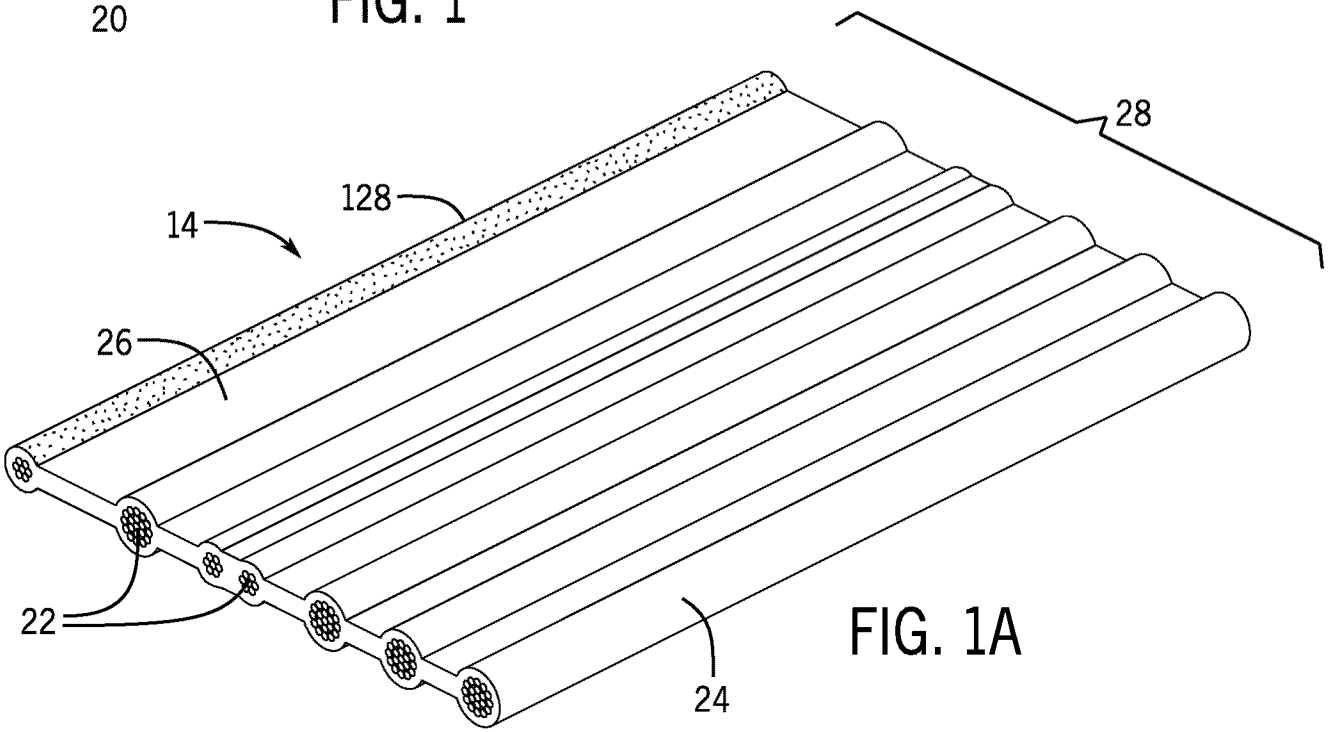
FIG. 1A is a perspective view of a multi-conductor ribbon cable.

As shown in FIG. 1A, a ribbon cable 14 for use in such a network 10 can include a plurality of parallel conductors 22 enclosed in a common insulation jacket 24. The conductors 22 can comprise a conductive material such as, but not limited to, copper or another conductive metal. The insulation jacket 24 can comprise an electrical insulating material such as, but not limited to, a plastic material. The insulation jacket 24 can sit on the conductors 22, e.g., as an extruded integral insulation, so that a cylindrical outer contour on the top and bottom of the ribbon cable 14 emerges, separated by flat insulation webbing 26 between conductors. In this manner, the ribbon cable 14 can define a ribbon profile 28 of curved, longitudinal tracks on top and bottom surfaces thereof. In some applications, all conductors 22 may be identical in size and equally spaced apart, forming a symmetrical ribbon profile 28; however, in other applications, the conductors 22 may differ in size and/or spacing, creating a varied or asymmetrical ribbon profile 28. According to the non-limiting example of FIG. 1A, the ribbon cable 14 includes seven extruded conductors 22 of various sizes, including four conductors 22 dedicated to power and three conductors 22 dedicated to data transfer, forming an asymmetrical ribbon profile 28.

In some embodiments, each connector 16 can be configured to be coupled to and guide the ribbon cable 14 to maintain power and data connections within the network 10. As such, all connectors 16 within the network 10 can include generally similar components, with some components and features being universal across all connectors 16, and other components and features being specific to a connector 16 to achieve particular physical and/or electrical connections within the network 10. For example, FIGS. 2-11 illustrate various connectors 30-38, according to some embodiments, for use in a network, such as the network 10 of FIG. 1.

Figure 4:
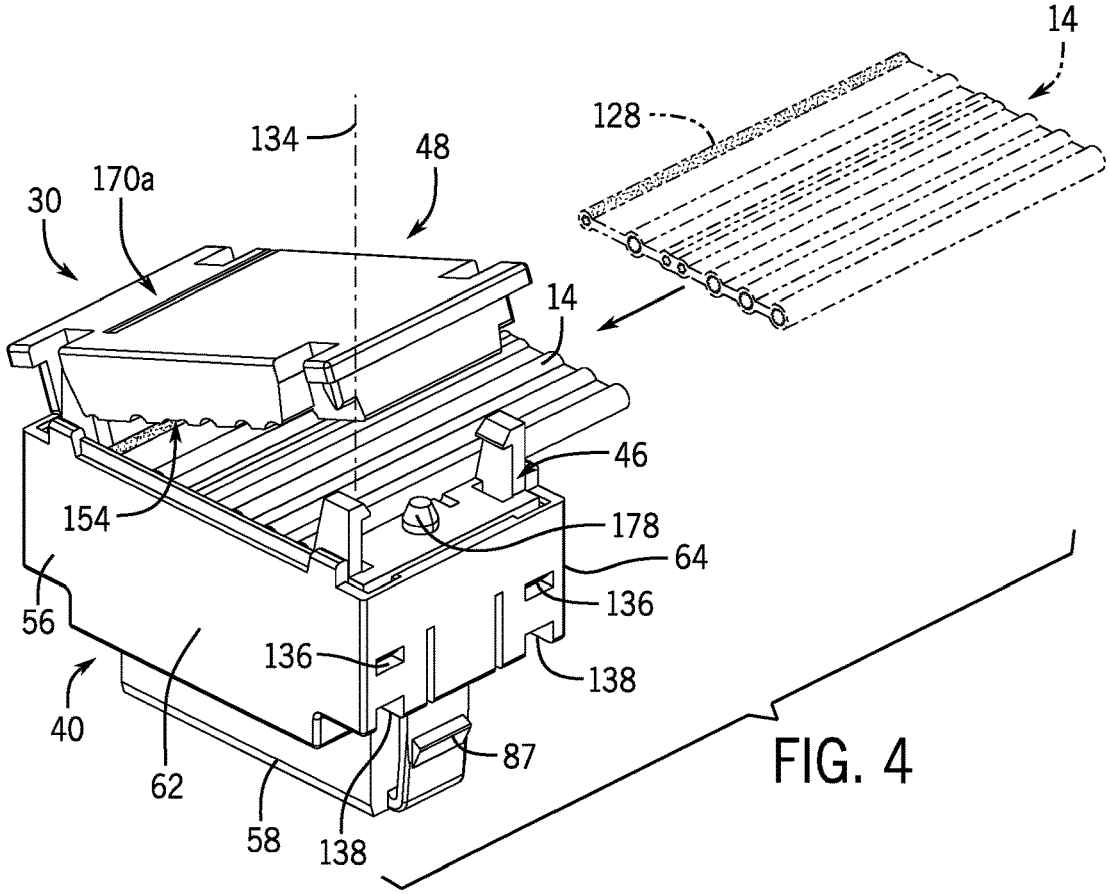
FIG. 4 is another perspective view of the power tap left connector of FIG. 2, including a ribbon cable therein.
Figure 5:
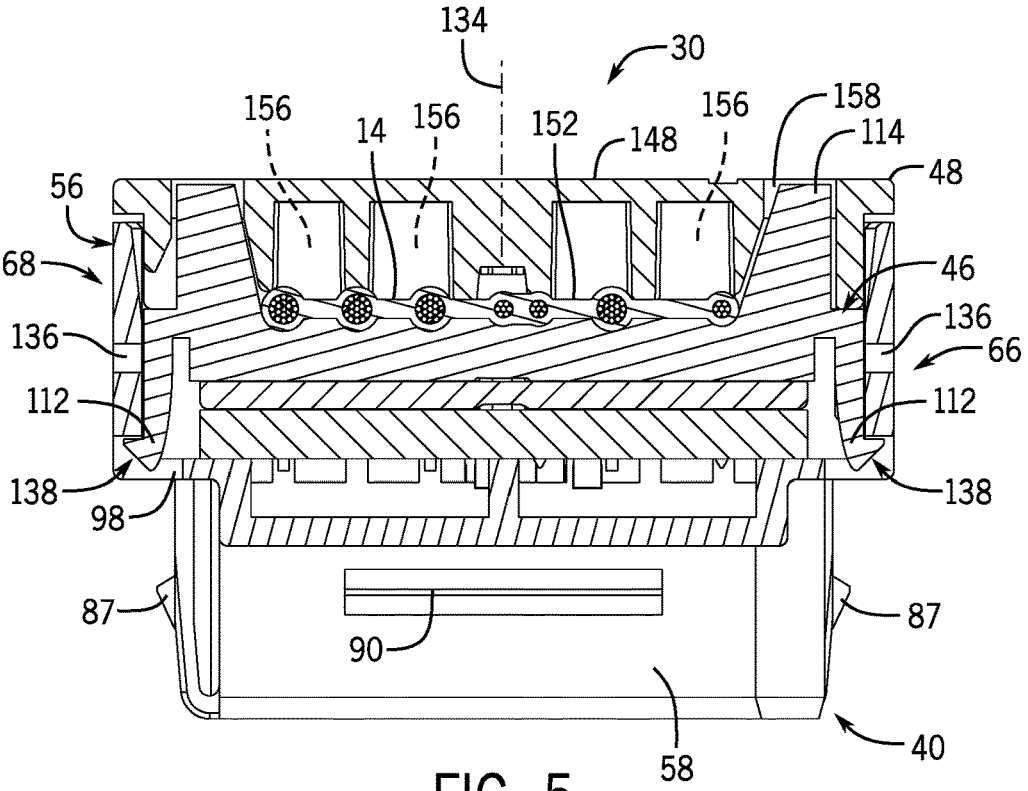
FIG. 5 is a cross-sectional view of the power tap left connector of FIG. 2 in an assembled state.
Figure 6:
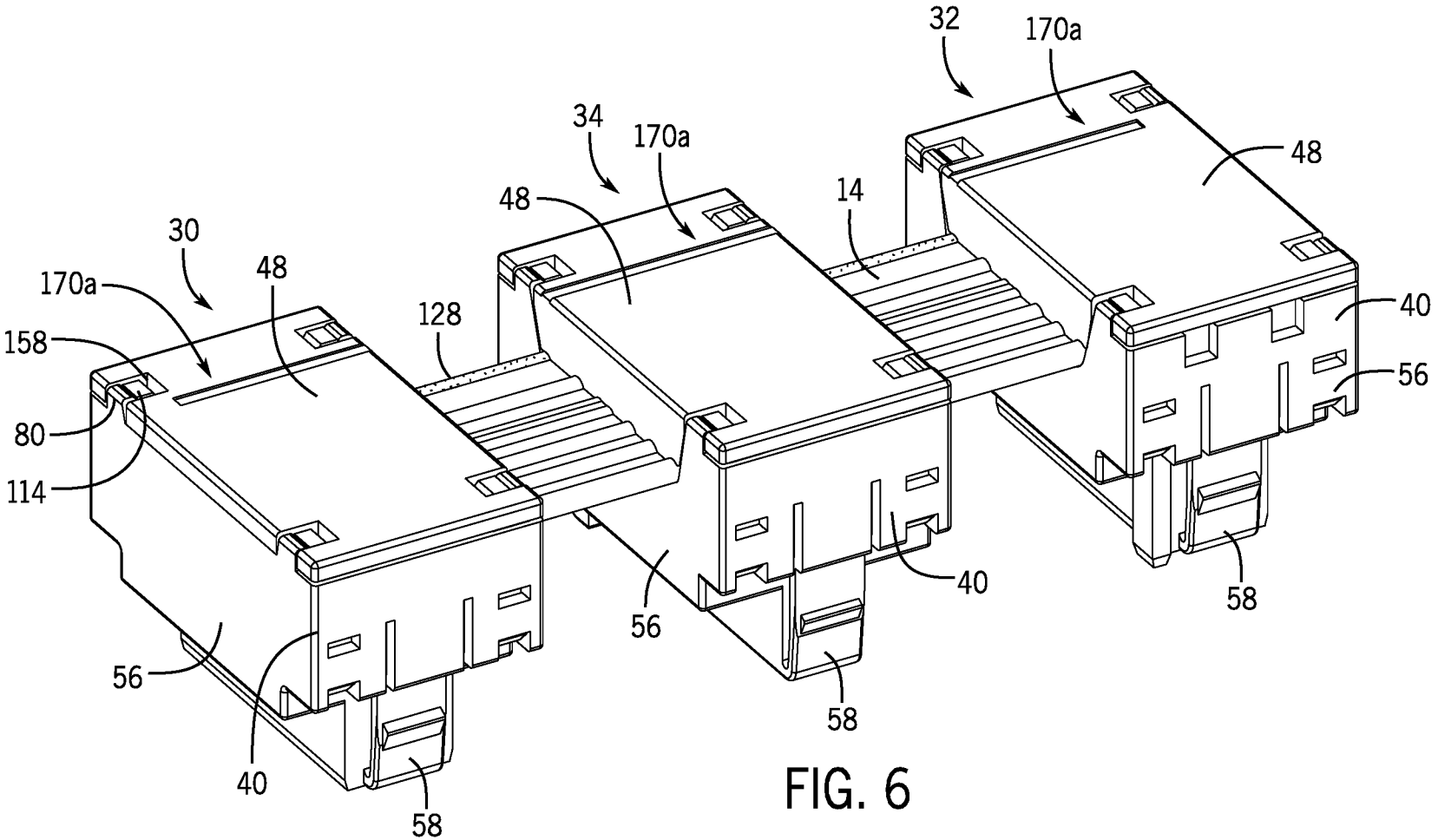
FIG. 6 is a perspective view of a power tap left connector, a node connector, and a power tap right connector, according to some embodiments, installed on a ribbon cable.
Figure 7:
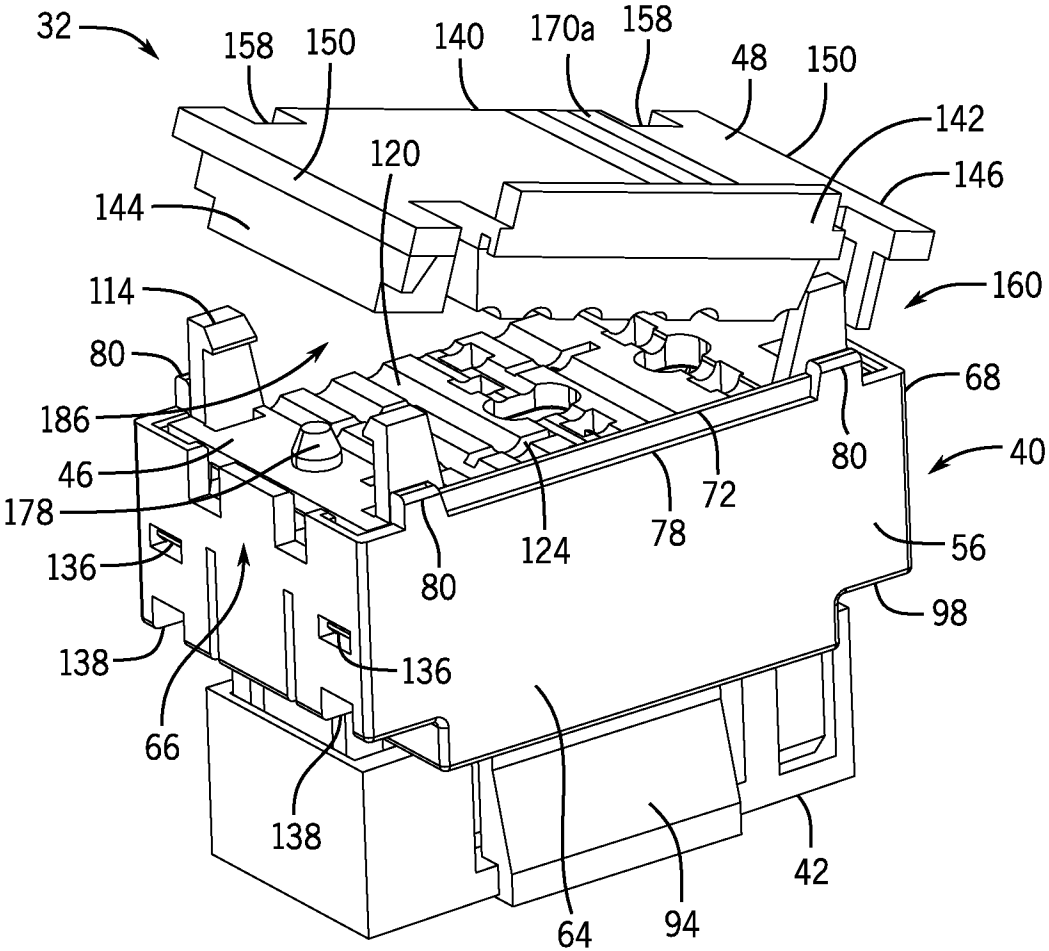
FIG. 7 is a perspective view of a power tap right connector, according to some embodiments, in a preassembled state.
Figure 8:
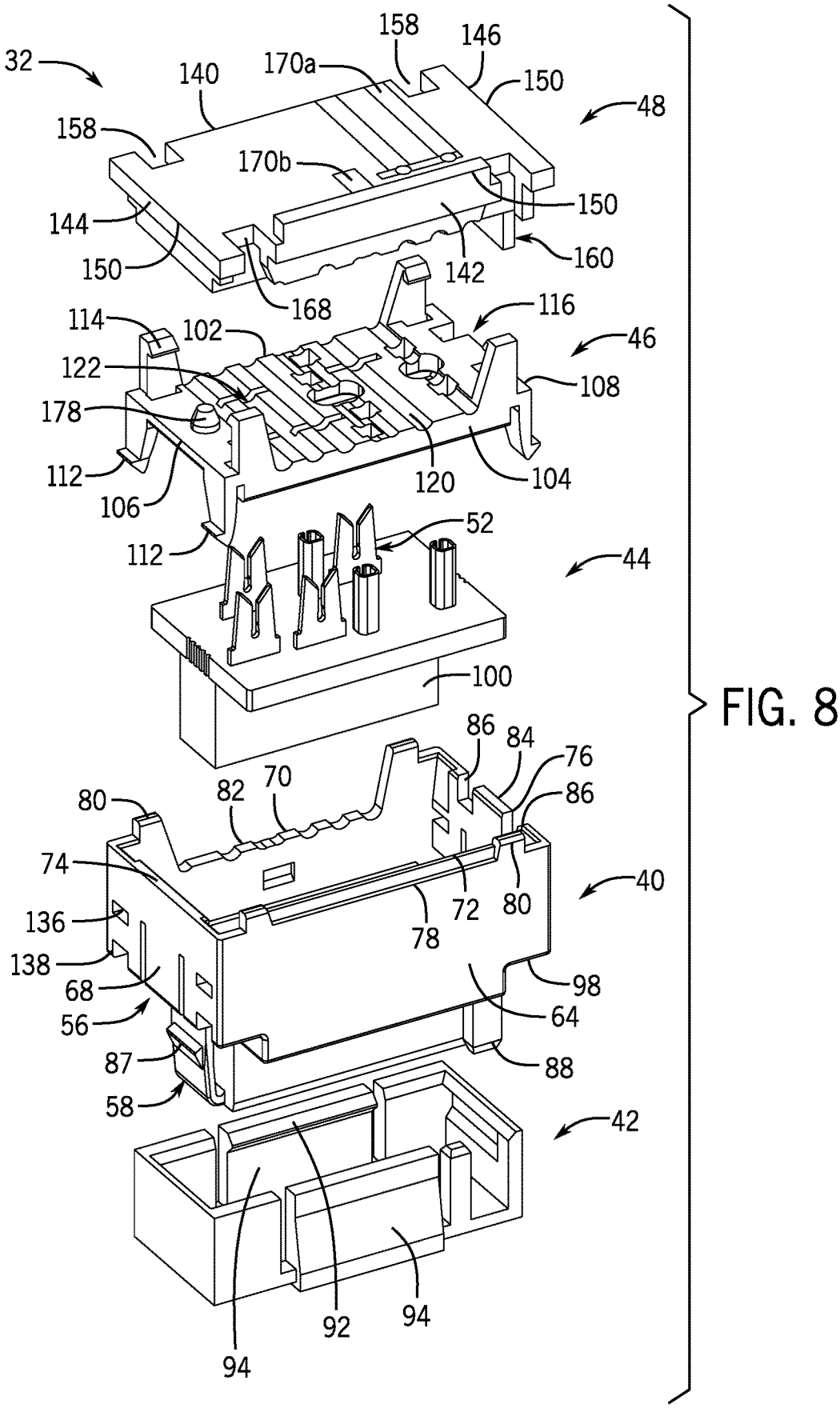
FIG. 8 is a perspective exploded view of the power tap right connector of FIG. 7.
Figure 9:
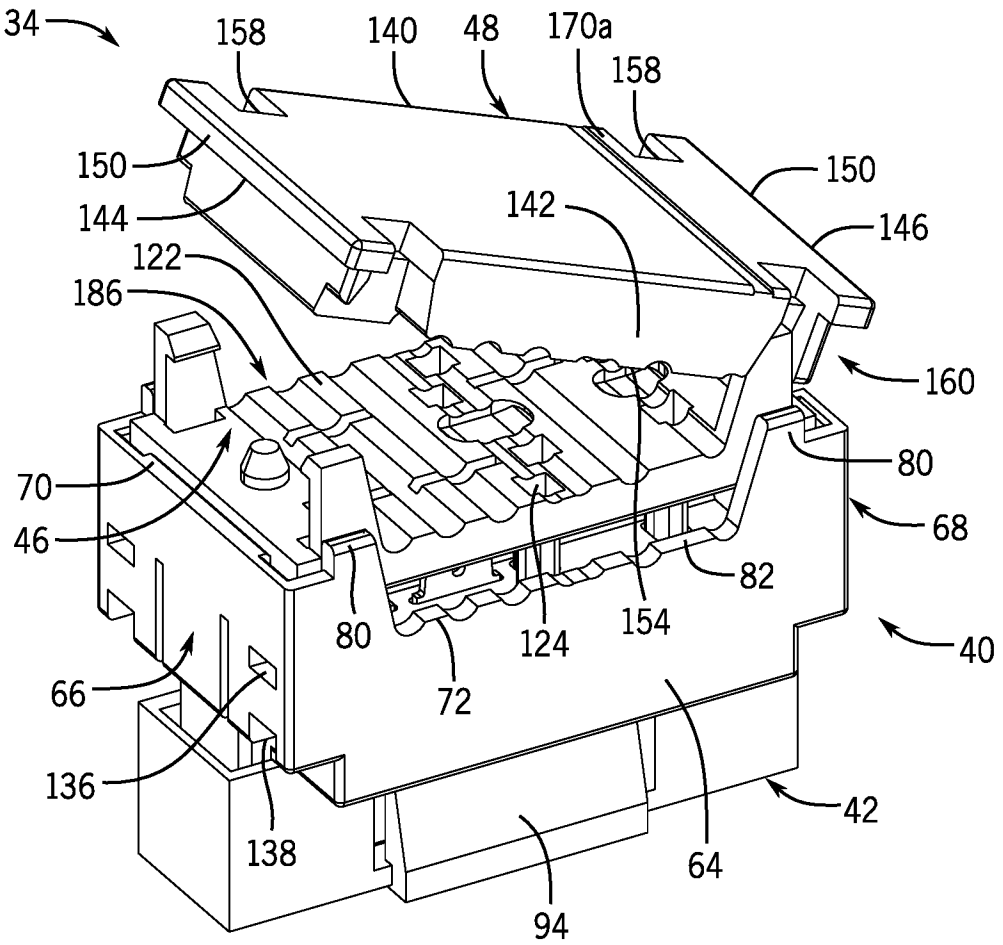
FIG. 9 is a perspective view of a node connector, according to some embodiments, in a preassembled state.
Figure 10:
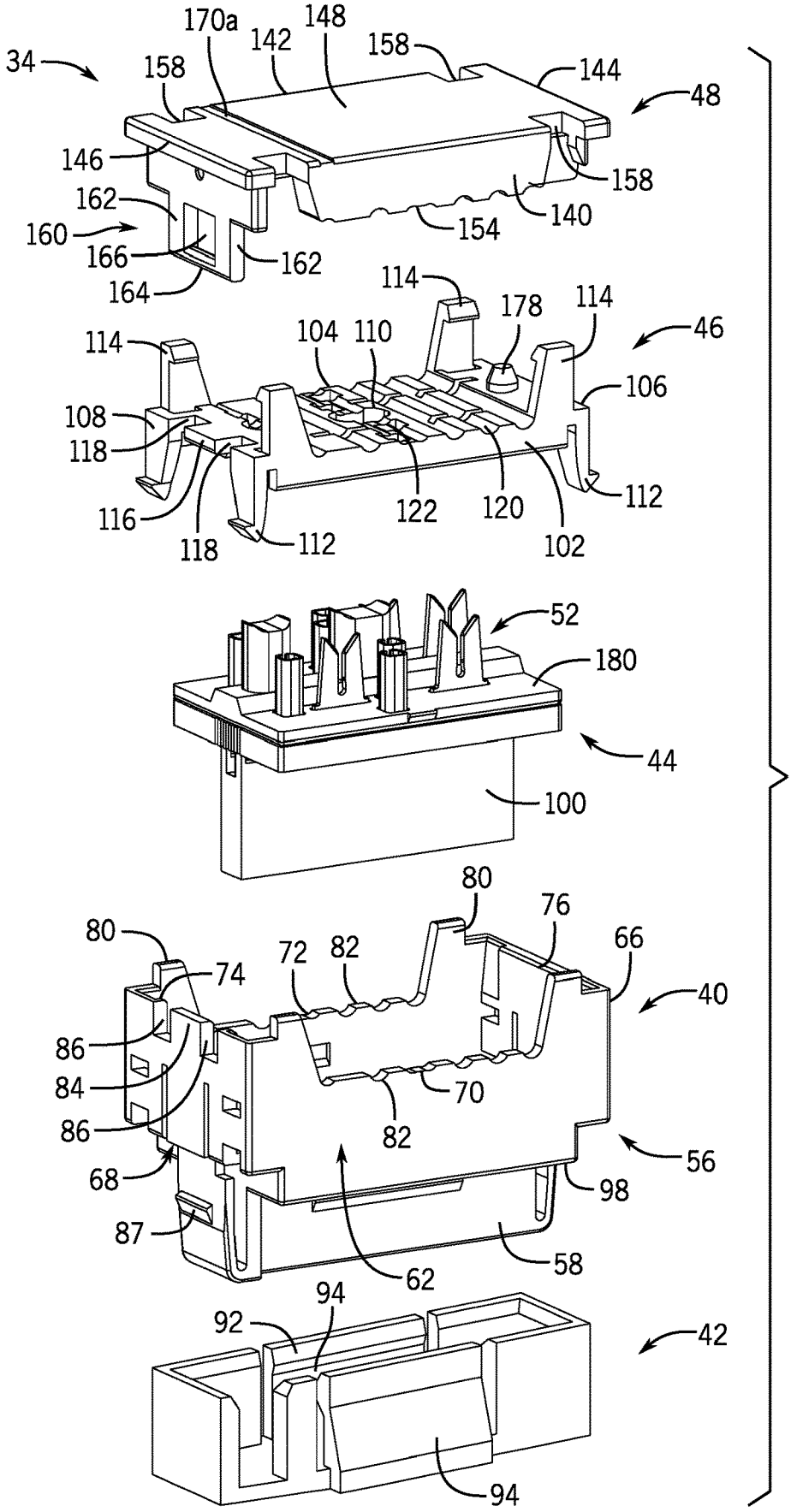
FIG. 10 is a perspective exploded view of the node connector of FIG. 9.
Figure 12:
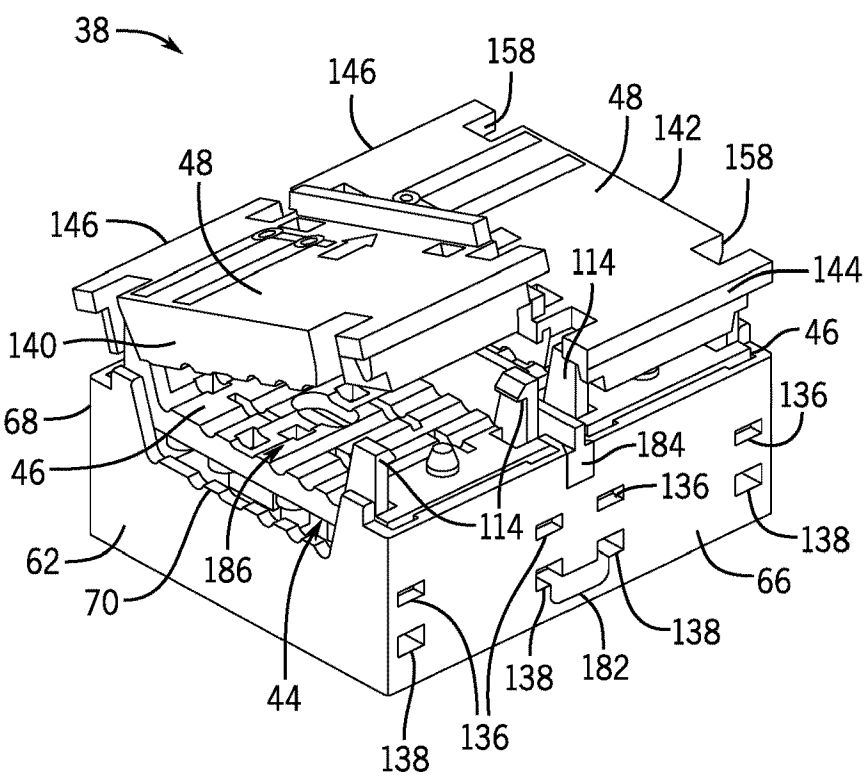
FIG. 12 is a perspective view of a splicer according to some embodiments.
Figure 11:
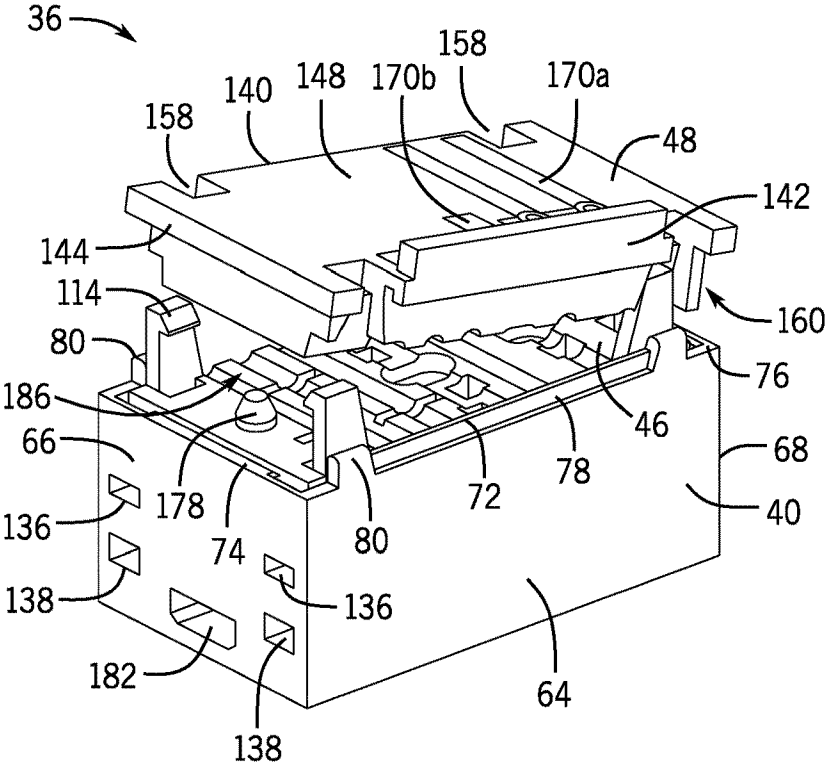
FIG. 11 is a perspective view of a terminator according to some embodiments.

More specifically, FIGS. 2-6 illustrate a first connector 30 (e.g., a "power tap left connector") configured to couple a ribbon cable 14 to a power tap to direct power in a first direction; FIGS. 6-8 illustrate a second connector 32 (e.g., a "power tap right connector") configured to couple a ribbon cable 14 to a power tap to direct power in a second direction; FIGS. 6, 9, and 10 illustrate a third connector 34 (e.g., a "node connector") configured to couple a ribbon cable 14 to a device node; FIG. 11 illustrates a fourth connector 36 (e.g., a "terminator") configured to terminate a ribbon cable 14; and FIG. 12 illustrates a fifth connector 38 (e.g., a "splicer") configured to splice together two ribbon cables 14. Generally, each connector 30-38 can include a housing 40, a cable organizer 46, and a cover 48, as further described below. Furthermore, each of the power tap left connector 30, the power tap right connector 32, and the node connector 34 can include a protection cap 42, and each of the power tap left connector 30, the power tap right connector 32, the node connector 34, and the splicer 38 can include a printed circuit board 44, as further described below.

Figure 2:
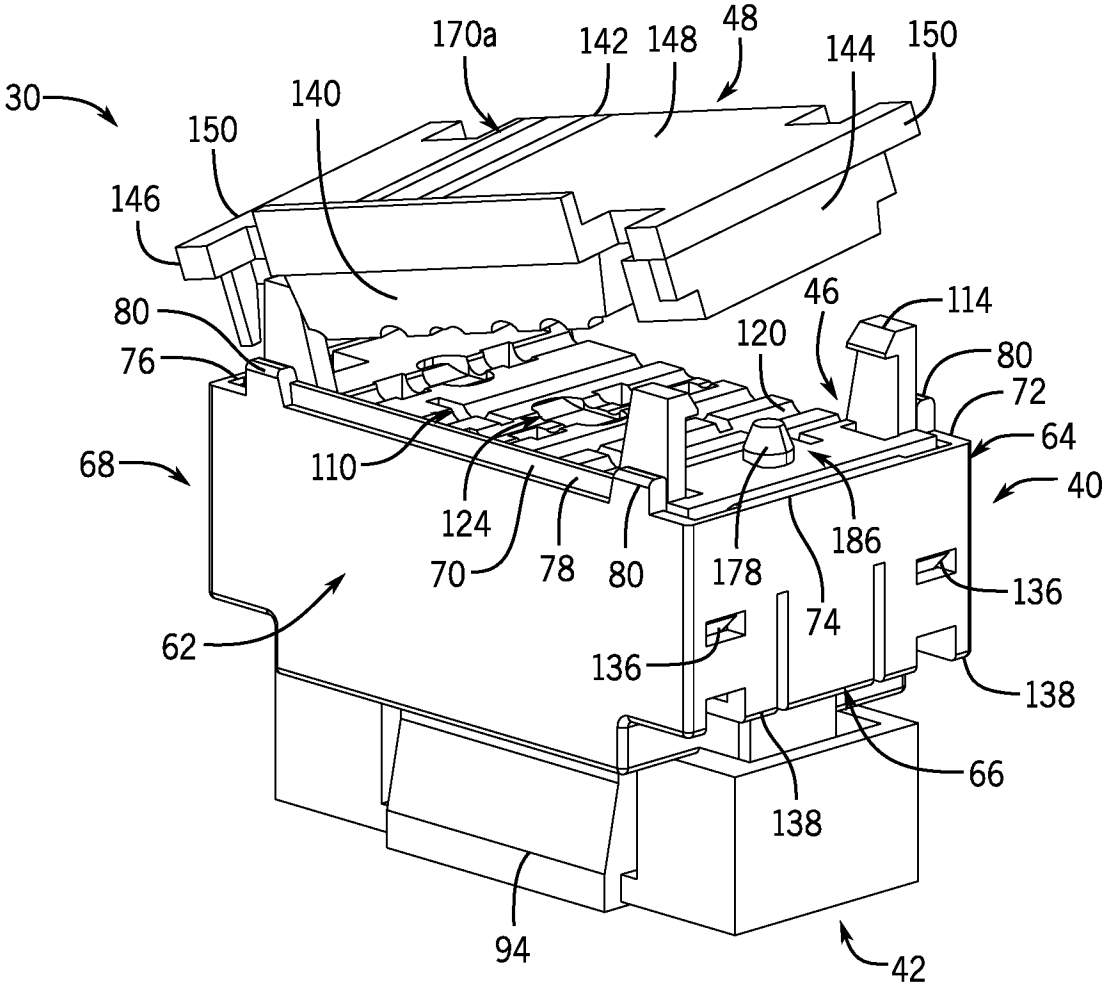
FIG. 2 is a perspective view of a power tap left connector, according to some embodiments, in a preassembled state.
Figure 3:
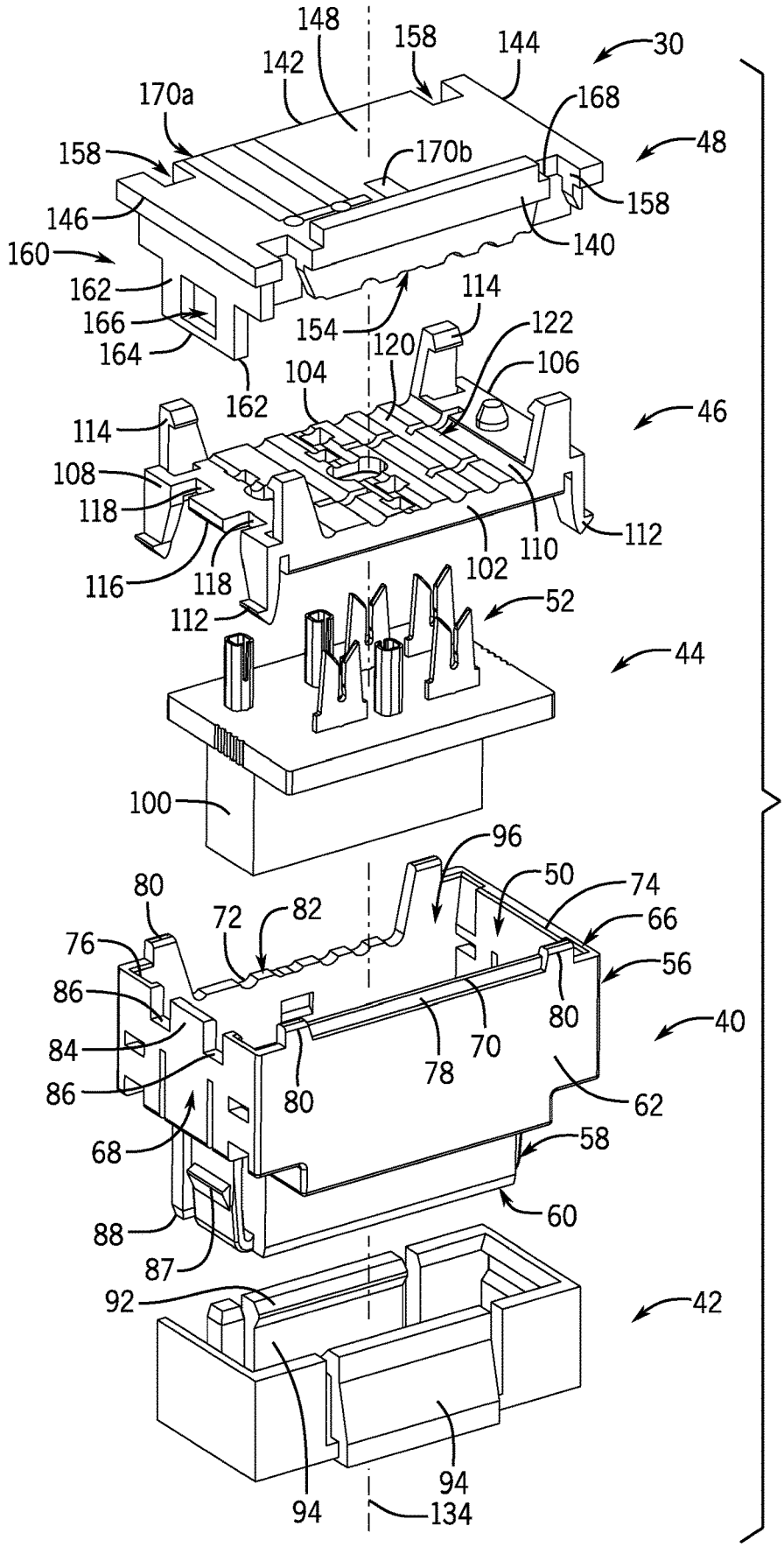
FIG. 3 is a perspective exploded view of the power tap left connector of FIG. 2.

More specifically, referring to FIGS. 2-12, the power tap left connector 30 can include a housing 40, a protection cap 42, a printed circuit board 44, a cable organizer 46, and a cover 48. Generally, a ribbon cable 14 can be positioned within (e.g., extend across) an open top 50 of the housing 40 and be supported by the cable organizer 46, as shown in FIG. 4. The ribbon cable 14 can be enclosed within the housing 40 by the cover 48 when the power tap left connector 30 is in an assembled state, as shown in FIGS. 5 and 6. When enclosed within the housing 40, individual conductors 22 of the ribbon cable 14 can engage one or more conductor contacts 52 (such as insulation-displacement contacts (IDCs) and/or insulation-piercing contacts (IPCs)) extending from the printed circuit board 44. The housing 40 can be further adapted to plug into a corresponding jack on a power tap to electrically and physically connect the ribbon cable 14 to the power tap.

More specifically, with respect to the housing 40, in some embodiments, the housing 40 can support and enclose the printed circuit board 44 and the cable organizer 46 therein, and can be coupled to the cover 48 in a manner so that open top 50 of the housing 40 can be selectively covered by the cover 48, as further described below. The housing 40 can be generally rectangular in shape and can include an upper section 56 and a lower section 58, an open top 50 (e.g., at the upper section 56) and an open bottom 60 (e.g., at the lower section 58), a first side 62, a second side 64, a first end 66, and a second end 68. As shown in FIG. 4, when a ribbon cable 14 is positioned in the housing 40, the ribbon cable 14 terminates along the first side 62 within the upper section 56, and extends out of the housing 40 from the second side 64.

The upper section 56 of the housing 40 can include a first side edge 70, a second side edge 72, a first end edge 74, and a second end edge 76 that define the open top 50. In some embodiments, the first side edge 70 can be a raised edge with a substantially straight profile, including an indented cover track 78 and one or more cover projections 80 that extend upward away from the housing 40. The first side edge 70 can be raised in order to cover a cut edge of a ribbon cable 14 when the ribbon cable 14 is coupled to the power tap left connector 30, that is, so that the cut edge of the ribbon cable 14 remains enclosed within the housing 40 when the ribbon cable 14 is coupled to the power tap left connector 30.

The second side edge 72 can be a lowered edge with a profile 82 configured to permit a ribbon cable 14 to extend out from the second side 64 of the housing 40 when the ribbon cable 14 is coupled to the power tap left connector 30. For example, as described above with respect to FIG. 1A, a ribbon cable 14 can include a ribbon profile 28 defined by outer contours of the insulated conductors 22 of the ribbon cable 14. The second side edge 72 can therefore include an inverse ribbon profile 82 between two cover projections 80 that substantially corresponds to the ribbon profile 28 of a ribbon cable 14, allowing the ribbon cable 14 to sit within the profile 82. As a result, the housing 40 can facilitate and maintain proper alignment of the ribbon cable 14 within the housing 40 when the ribbon cable 14 is coupled to the power tap left connector 30.

Furthermore, the first end edge 74 of the upper section 56 of the housing 40 can include a straight profile. The second end edge 76 of the upper section 56 of the housing 40 can include a first latch extension 84. For example, the second end edge 76 can include spaced apart notches 86 that define the first latch extension 84, extending vertically upward, therebetween. As further described below, the first latch extension 84 and the notches 86 can support rotation and translation of the cover 48 relative to the housing 40.

In some embodiments, as shown in FIGS. 3-5, the lower section 58 of the housing 40 can be integral with the upper section 56, though smaller than the upper section 56. The lower section 58 can be dimensioned to define the open bottom 60 and also to plug into a power tap jack of a power tap (such as the intelligent power tap 18 or the non-intelligent power tap 20 of FIG. 1). For example, the lower section 58 can include spring-like protrusions 87 (e.g., on first and second ends 66, 68) that facilitate coupling the connector 30 to a power tap jack when the housing 40 is plugged into the power tap jack. For example, the protrusions 87 can engage mating seats within the power tap jack (not shown) when the lower section 58 is plugged into the power tap jack. Furthermore, to facilitate proper directional (e.g., right-left) alignment of the connector 30 with a power tap jack, the lower section 58 can be longer on the second end 68 than the first end 66 to define a corner extension 88. As a result, the lower section 58 can include a generally rectangular profile with the corner extension 88, which matches a corresponding rectangular opening and corner extension of the power tap jack (not shown). With this configuration, the connector 30 may only be coupled to the power tap in one orientation, when the corner extensions 88 align.

Furthermore, the lower section 58 of the housing 40 can be selectively covered by the protection cap 42 in order to cover the open bottom 60. As a result, the protection cap 42 can protect an interior of the housing 40 from outside elements when the connector 30 is not connected to a power tap and can protect components within the interior of the housing 40 (such as the printed circuit board 44) from tooling when the connector 30 is placed in its assembled state, as further described below. In some embodiments, the lower section can include grooves 90 (e.g., along first and second sides 62, 64), as shown in FIG. 5, configured to receive detents 92 of the protection cap 42 to couple the components together. More specifically, the protection cap 42 can include pivotable latches 94 with the detents 92 adjacent inner, top ends thereof. At rest, the latches 94 can urge inward; however, the latches 94 can be rotated outward when bottom ends of the latches 94 are pressed. As a result, a user can squeeze the bottom ends of the latches 94 to place the protection cap 42 over the lower section 58 of the housing 40 until the top ends of the latches 94 are adjacent the upper section 56, and then release the bottom ends so that the detents 92 urge inward to engage the grooves 90 and fix the protection cap 42 to the lower section 58. To disengage the protection cap 42 from the housing 40, the user can again squeeze the latches 94 to release the detents 92 from the grooves 90 and freely slide the protection cap 42 off the lower section 58. In some embodiments, the protection cap 42 can be in the form of a protection cap jack, containing circuitry and incorporating electrical contact pins which mate to the connector socket receptacle 100 in a fashion similar to how a device (in this example, a power tap) would mate with the connector socket receptacle 100. Accordingly, should the connector 30 be removed from the device, for example in the event of device repair or replacement, the protection cap jack could replace the device either temporarily or permanently, thereby maintaining the data transmission and signal integrity along the ribbon cable data conductors 22.

As shown in FIG. 3, the upper and lower sections 56, 58 of the housing 40 can define an interior space 96 that houses the printed circuit board 44. More specifically, in some embodiments, the printed circuit board 44, such as a printed circuit board assembly, can sit within the housing 40 and can include, extending from an upper end thereof, one or more individual and distinct conductor contacts 52, each of which are separately soldered or pressed-in to the printed circuit board 44 with a mechanical and electrical connection, sufficient to connect the printed board circuits to the various individual conductors 22 of the ribbon cable 14. For example, in some embodiments, the conductor contacts 52 can include one or more insulation-displacement contacts (IDCs) and/or one or more insulation-piercing contacts (IPCs).

In some embodiments, the printed circuit board 44 and the conductor contacts 52 are positioned within the upper section 56 of the housing 40. For example, the upper section 56 can include a bottom seat 98 defined by an inward-stepped portion that connects that upper section 56 to the lower section 58, and the bottom seat 98 can support the printed circuit board 44 within the upper section 56. In some embodiments, the printed circuit board 44 can extend within the interior space 96 across the upper section 56 to define open areas between respective ends of the printed circuit board 44 and the first and second ends 66, 68 of the housing 40. As further described below, lower detents 112 of the cable organizer and/or portions of the cover 48 can extend into the open areas.

The conductor contacts 52 can be located along the printed circuit board 44 so that they can be configured to electrically contact individual conductors 22 of a ribbon cable 14 when the connector 30 is in its assembled state, as further described below. For example, in some embodiments, the printed circuit board 44 of the power tap left connector 30 is configured only to electrically engage power conductors 22 of a ribbon cable 14. In other embodiments, however, the printed circuit board 44 of the power tap left connector 30 can be configured to engage power and data conductors 22 of the ribbon cable 14.

The printed circuit board 44 further includes, extending from a lower end thereof into the lower section 58 of the housing 40, a connector socket receptacle 100 electrically coupled to the conductor contacts 52 and accessible via the open bottom 60 of the housing 40. For example, the connector socket receptacle 100 can be adapted to plug into a corresponding power tap jack on a power tap to electrically and physically connect the ribbon cable to the power tap when the lower section 58 of the housing 40 is plugged into the power tap jack.

As noted above, the conductor contacts 52 can be positioned to individually contact conductors 22 of a ribbon cable 14, and the cable organizer 46 can be configured to maintain a position of the ribbon cable 14 to enable such connections. More specifically, still referring to FIGS. 2-6, the cable organizer 46 can sit within and be supported by the housing 40, positioned over top of the printed circuit board 44 so that it accessible via the open top 50 of the housing 40.

The cable organizer 46 can include a first side 102, a second side 104, a first end 106, and a second end 108 that generally align with the first side 62, the second side 64, the first end 66, and the second end 68, respectively, of the housing 40. The cable organizer 46 can also include a generally flat surface 110 with one or more lower detents 112 that extend generally downward from the flat surface 110 (e.g., along corners of the cable organizer 46 or at other positions along the sides 102, 104 or ends 106, 108) and one or more upper detents 114 that extend generally upward from the flat surface 110 (e.g., along corners of the cable organizer 46 or at other positions along the sides 102, 104 or ends 106, 108). Furthermore, as shown in FIG. 3, the cable organizer 46 can include a second latch extension 116 that extends from the second end 108. For example, the second end 108 can include spaced apart notches 118 that define the second latch extension 116, extending horizontally outward, therebetween. As such, the second latch extension 116 can extend generally perpendicular relative to the first latch extension 84.

In some embodiments, the cable organizer 46 can include a plurality of longitudinal grooves or guideways 120 in the flat surface 110 extending from the first side 102 to the second side 104 thereof and configured to receive insulated conductors 22 of a ribbon cable 14. For example, as described above, a ribbon cable 14 includes a ribbon profile 28 defined by outer contours of the insulated conductors 22. The longitudinal guideways 120 of the cable organizer 46 can define an inverse ribbon profile 122 that substantially corresponds to the ribbon profile 28 of the ribbon cable 14 (e.g., matching the inverse ribbon profile 82 of the second side edge 72 of the housing 40), thus permitting proper alignment of individual conductors 22 of the ribbon cable 14 within the connector 30 when the ribbon cable 14 is placed on the cable organizer 46.

The cable organizer 46 further includes a plurality of apertures 124 extending through one or more of the longitudinal grooves 120 and configured to axially align with the conductor contacts 52, as further described below. In some embodiments, to facilitate proper alignment of the ribbon cable 14 within the cable organizer so that respective conductor contacts 52 engage desired conductors 22, especially for ribbon cables 14 with asymmetric profiles 28, one or more guideways 120 of the cable organizer 46 can include an orientation indicator, such as a colored stripe (not shown). The colored stripe can be aligned with a mating colored strip 128 on a ribbon cable 14 when the ribbon cable 14 is placed on the cable organizer 46, as shown in FIG. 4. In some embodiments, the cable organizer 46 and/or the ribbon cable 14 can include other types of orientation indicators.

To further facilitate ribbon cable installation, the cable organizer 46 can be moveable in an axial direction within the housing 40, for example, along an axis 134. In some embodiments, the cable organizer 46 can be moved between a first position when the connector 30 is in a preassembled state (as shown in FIGS. 2 and 4) and a second, lower position when the connector 30 is in an assembled state (as shown in FIGS. 5 and 6). For example, in some embodiments, the housing 40 can include one or more upper slots 136 extending through the first and second ends 66, 68, and one or more lower slots 138 extending through the first and second ends 66, 68 and positioned a distance below the upper slots 136. In some embodiments, the upper slots 136 and the lower slots 138 can extend entirely through the first and second ends 66, 68, while in other embodiments, the slots 136, 138 may be blind holes that extend only partially through the first and second ends 66, 68 from the interior 96 of the housing 40. The lower detents 112 of the cable organizer 46 can be configured to engage or snap into the slots 136, 138 of the housing 40 when the cable organizer 46 is in the first position and the second position, respectively.

More specifically, in the preassembled state, the lower detents 112 can each engage a respective upper slot 136 of the housing 40. In this position, as shown in FIGS. 2 and 4, the flat surface 110 of the cable organizer 46 can generally align with the flat, first end edge 74 of the housing 40 (thus placing the cable organizer 46 within, or extending across, the open top 50) and the inverse ribbon profile 122 of the cable organizer 46 can be positioned above the inverse ribbon profile 82 of the second side edge 72 of the housing 40. Furthermore, in the preassembled state, an outer edge of the second latch extension 116 can generally align with and be adjacent to an outer edge the first latch extension 84 at the second end edge 76 of the housing 40 so that the respective notches 118, 86 are aligned. Additionally, in the preassembled state, the cable organizer 46 is spaced a first distance above the printed circuit board 44 so that the conductor contacts 52 do not extend through the apertures 124 of the cable organizer 46.

In the assembled state, the cable organizer 46 can be pressed axially downward along the axis 134 into the housing 40 so that the lower detents 112 disengage the upper slots 136 and slide down the interior 96 of the housing until they each engage (e.g., snap into) a respective lower slot 138, as shown in FIG. 5. In this position, the inverse ribbon profile 122 of the cable organizer 46 can be aligned with the inverse ribbon profile 82 of the second side edge 72 of the housing 40. Furthermore, in the assembled state, the upper detents 114 of the cable organizer 46 can align with and be adjacent to the projections 80 on the first and second side edges 70, 72 of the housing 40, as shown in FIG. 6, and the second latch extension 116 can be positioned below the first latch extension 84. Additionally, in the assembled state, the cable organizer 46 is spaced a second distance above the printed circuit board 44 so that the conductor contacts 52 extend through the apertures 124 and, as a result, can engage the individual conductors 22 of the ribbon cable 14 received within the longitudinal grooves 120.

In the assembled state, the cable organizer 46 can be enclosed within the housing 40 by the cover 48. In some embodiments, as shown in FIGS. 2-6, the cover 48 can be generally rectangular in shape and include a first side 140, a second side 142, a first end 144, and a second end 146. The cover 48 can also include an upper surface 148 with extended edges 150 along the first end 144, the second end 146, and the first side 140. A bottom surface 152 of the cover 48 can include an inverse cable profile 154 extending from the first side 140 to the second side 142 (e.g., corresponding to the cable profile 28 of a ribbon cable 14) and one or more apertures or indentations 156 (as shown in FIG. 5). The cover 48 can include one or more notches 158 at or adjacent the first side 140 and the second side 142, extending partially or completely through the upper and bottom surfaces 148, 152. Furthermore, the cover 48 can include a latch 160 extending downward from the second end 146. For example, the latch 160 can be substantially U-shaped with two extensions 162 extending downward from the second end 146 and a horizontal bar 164 connecting lower ends of the extensions 162 to define an open slot 166 between the second end 146, the extensions 162, and the bar 164. In some embodiments, the open slot 166 can be sized to receive the first latch extension 84 or the second latch extension 116, and the extensions 162 can be sized to permit their free movements within the notches 86, 118, as further described below.

When in the assembled state, the cover 48 can cover the open top 50 of the housing 40 to capture and entrap the ribbon cable 14 within the housing 40 between the cover 48 and the cable organizer 46. That is, the ribbon cable 14 can be held between the lower inverse ribbon profile 122 of the cable profile and the inverse cable profile 154 of the bottom surface 152 of the cover 48, thereby preventing vertical and/or horizontal movement of the ribbon cable 14 within the connector 30 to facilitate secured connections between the cable conductors 22 and the conductor contacts 52. For example, as shown in FIG. 6, the first side 140, the second side 142, the first end 144, and the second end 146 of the cover 48 can generally align with the first side edge 70, the second side edge 72, the first end edge 74, and the second end edge 76, respectively, of the housing 40. The extended edges 150 of the first and second ends 144, 146 and the first side 140 can also rest upon the first and second end edges 74, 76 and the first side edge 70 of the housing 40, respectively. Furthermore, as shown in FIG. 6, the notches 158 of the cover 48 can align with and receive the projections 80 and upper detents 114 of the housing 40 and the cable organizer 46, respectively. More specifically, as shown in FIG. 3, each notch 158 can include a shoulder 168 onto which a respective upper detent 114 can engage when the cover 48 is pressed onto the housing 40, thus locking together the connector 30 in the assembled state, coupling the cover 48 to the cable organizer 46.

Additionally, in some embodiments, as shown in FIGS. 2, 3, and 6, the upper surface 148 of the cover 48 can include one or more features 170 that provide information to a user, for example, when the connector 30 is in the assembled or preassembled state. According to a first example, the cover 48 can include a first feature in the form of a horizontal line 170*a* adjacent the first or second end 144, 146. The line 170*a* may be an indented or protruding line formed in the upper surface 148, or a colored line applied (e.g., painted on, etched on, etc.) to the upper surface 148. The line 170*a* can align with the cable orientation strip along the cable organizer 46 to further assist proper positioning of a ribbon cable 14 in the connector 30 and assist with proper orientation of the connector 30 relative to a power tap. In another example, the cover 48 can include a second feature in the form of a terminated edge indicator 170*b* adjacent the first side 140 or the second side 142. The indicator 170*b* can be a square, rectangle, line, arrow, or other shape formed as an indent or protrusion in the upper surface 148 or applied to the upper surface 148. For example, in the power tap left connector 30, a cut end of a ribbon cable 14 is adjacent a first, or left, side thereof, and the ribbon cable 14 extends out of the connector from the second, or right, side thereof. Thus, the terminated edge indicator 170*b* can indicate to a user a position of a cut edge of an installed ribbon cable 14 (e.g., along the first side 140) and/or a direction of ribbon travel (e.g., toward the second side 142). Alternatively, the horizontal line 170*a* can indicate both alignment of the cable orientation strip and direction of ribbon travel. For example, as shown in FIG. 6, the horizontal line 170*a* extends across the upper surface 148 to the second side 142, but stops short of the first side 140, indicating that ribbon travel does not extend past the first side 140.

In some embodiments, in the preassembled state, as shown in FIGS. 2 and 4, the cover 48 can remain coupled to, and also move relative to, the housing 40 via the latch 160 engaging with the first latch extension 84 and/or the second latch extension 116. For example, in the preassembled state, the latch extensions 84, 116 can be positioned relative to one another to prevent the latch 160 from being disengaged with the latch extensions 84, 116. In this manner, the latch 160 of the cover 48, the first latch extension 84 and notches 86 of the housing 40, and the second latch extension 116 and notches 118 of the cable organizer 46 form a latch assembly of the connector 30 that permits the cover 48 to be moved relative to the housing 40. More specifically, as described above, in the preassembled state, the cable organizer 46 is positioned relative to the housing 40 so that second latch extension 116 aligns with a top edge the first latch extension 84 of the housing 40, and the notches 86 align with the notches 158. Furthermore, the second latch extension 116 can extend through the open slot 166 of the cover latch 160, thus maintaining the bar 164 within the interior 96 of the housing 40.

As a result, the cover 48 can freely translate along the axis 134 in a first, upward direction, with the extensions 162 able to move through the notches 118, until reaching an upward-most position when the bar 164 engages the second latch extension 116 and stops vertical movement. And the cover 48 can freely translate in a second, downward direction until reaching a downward-most position when the second end 146 of the cover 48 engages the second latch extension 116 and stops vertical movement. Thus, the cover 48 can freely translate along the axis 134 a specified vertical distance between the upward-most position and the downward-most position.

Furthermore, while vertical movement is permitted, horizontal movement of the cover 48, along a plane perpendicular to the axis 134, can be generally restricted in a first direction (e.g., toward the first end 144) due to the extensions 162 contacting the cable organizer 46, in a second, opposite direction (e.g., toward the second end 146) due to the extensions 162 and/or the bar 164 contacting the second end 68 of the housing 40, and in third and fourth directions perpendicular to the first direction (e.g., toward the first and second sides 140, 142) due to the extensions 162 contacting the second latch connector 116.

However, because the notches 86 of the housing 40 align with the notches 118 of the cable organizer 46 in the preassembled state, the cover 48 can freely rotate relative to the housing 40. More specifically, the cover 48 can be rotated away from the housing 40 so that the extensions 162 of the latch 160 move from the notches 118 of the cable organizer 46 into the notches 86 of the cover 48, until the first latch extension 84 extends through the slot 166. For example, the latch 160 can rotate within the notches 86, 118 until the bar 164 engages a lower surface of the second latch extension 116. Due to the free vertical movement of the cover 48, as described above, the latch 160 is not rotated about a fixed axis but, rather, can be rotated about a moving axis anywhere along the specific vertical distance. For example, the axis may be defined by the vertical position of the cover and, more specifically, by a position of the second latch extension 116 within the open slot 166.

Accordingly, the cover 48 can be moved along a non-specific trajectory with a combination of translations and rotations, creating a moving axis and an extended range of motion greater than, for example, a fixed axis hinge joint or a floating hinge with two parallel axes of rotation. In this manner, the cover 48 can be closed in a less constrained manner, regardless of varying cable cross-sections, multiple conductors of equal or mixed sizes, and other obstructive physical barriers and features.

Additionally, when in the assembled position, as shown in FIGS. 5 and 6, the latch 160 engages with the second latch extension 116, which is positioned below the first latch extension 84. For example, the second latch extension 116 can be positioned below the first latch extension 84 so that the notches 118 no longer align with the notches 86 but, rather, align with the solid surface of the second end 68 of the housing. The cover 48, therefore, cannot rotate because the extensions 162 engage the solid second end 68 of the housing 40 rather than the open notches 86. Thus, the cover 48 can be rotated so that the latch 160 engages the first latch extension 84 in the preassembled state to facilitate insertion of a ribbon cable 14, as described below. And to assemble the connector 30 in the assembled state, the latch 160 can be rotated back so that the latch 160 engages the second latch extension 116. In some embodiments, to facilitate proper alignment once rotated back, the cable organizer 46 can include a protrusion 178 that can fit into an aperture (e.g., a blind hole, not shown) through the bottom surface 152 of the cover 48 adjacent the first end 144. Once aligned, the cover 48 is translated downward into the housing 40 so that further rotation is hindered.

The latch assembly described above allows re-use of the cover 48 with a multiplicity of connectors (as further described below), thus creating several variant combinations which take advantage of the same, universal cover 48. In some embodiments, the cover 48 may be coupled to the housing 40 at all times, in both the preassembled and assembled states, therefore reducing the chances of losing components. However, in some embodiments, the cover 48 may be configured to be selectively uncoupled from the housing 40.

While the connector described above with respect to FIGS. 2-6 is a power tap left connector 30, one or more of the above-described components and features can be incorporated into other connectors in a network, such as the network 10 of FIG. 1. For example, FIGS. 6-8 illustrate a power tap right connector 32; FIGS. 6, 9, and 10 illustrate a node connector 34; FIG. 11 illustrates a terminator 36; and FIG. 12 illustrates a splicer 38. In some embodiments, unless specified otherwise below, any one or more of the above-described components of the power tap left connector 30 can be incorporated into any one of the power tap right connector 32, the node connector 34, the terminator 36, and/or the splicer 38. Thus, in FIGS. 6-11, like numerals illustrate like components as described above with respect to the power tap left connector 30 of FIGS. 2-6. And, while any of the above-described features of the like components of the power tap left connector 30 can be incorporated into any one of the power tap right connector 32, the node connector 34, the terminator 36, and/or the splicer 38 in some embodiments, such features will not be described in detail again below for the sake of brevity.

For example, as shown in FIGS. 6-8, the power tap right connector 32 can include a housing 40, a protection cap 42, a printed circuit board 44, a cable organizer 46, and a cover 48. However, the power tap right connector 32 can generally be a mirror image of the power tap left connector 30. More specifically, in the power tap left connector 30, as described above, a cut end of a ribbon cable 14 is adjacent the first, or left, side thereof, and the ribbon cable extends out of the connector from the second, or right, side thereof. However, in the power tap right connector 32, a cut end of a ribbon cable 14 is adjacent a second, or right, side thereof, and the ribbon cable extends out of the connector from the first, or left, side thereof.

As such, with respect to the housing 40, while the first latch extension 84 can remain positioned along the second end 68 of the housing 40, like the power tap left connector 30, features on the first side 62 of the housing 40 of the power tap left connector 30 (such as the raised edge with substantially straight profile) can be incorporated on the second side 64 of the housing 40 of the power tap right connector 32, and features on the second side 64 of the housing 40 of the power tap left connector 30 (such as the inverse ribbon profile 82) can be incorporated on the first side 62 of the housing 40 of the power tap right connector 32. Furthermore, in some embodiments, the printed circuit board 44 can include conductor contacts 52 in the same relative locations, so that the power tap right connector 32 can engage the same conductors 22 as the power tap left connector 30.

Additionally, as shown in FIGS. 7 and 8, the cable organizer 46 of the power tap right connector 32 can be identical to the cable organizer 46 of the power tap left connector 32, and oriented within the housing 40 so that the second latch extension 116 aligns at the same end 68 of the housing 40 as the first latch extension 84. In some embodiments, the cable organizer 46 can include additional apertures 124 so as to accommodate multiple patterns of conductor contacts 52 to be used in any one of the power tap left connector 30, the power tap right connector 32, the node connector 34, the terminator 36, and/or the splicer 38. As such, the cable organizer 46 can be a universal cable organizer 46 for use in any type of connector 30-38. However, in other embodiments, the cable organizer 46 can include apertures 124 specific only to one, two, or more types of connectors 30-38.

Still referring to FIGS. 6-8 and the power tap right connector 32, the cover 48 can be a mirror image of the cover 48 of the power tap left connector 32. For example, while the latch 160 can remain positioned along the second end 146 of the cover 48, like the power tap left connector 30, features on the first side 140 of the cover 48 of the power tap left connector 30 (such as the extended edge 150) can be incorporated on the second side 142 of the cover 48 of the power tap right connector 32, and features on the second side 142 of the housing 40 of the power tap left connector 30 can be incorporated on the first side 140 of the cover 48 of the power tap right connector 32.

Furthermore, the upper surface 148 of the cover 48 can include one or more features 170, such as a terminated edge indicator 170*b* adjacent the second side 142 (e.g., in an opposite position as the terminated edge indicator 170*b* of the power tap left connector 30). For example, as described above, in the power tap right connector 32, a cut end of a ribbon cable 14 is adjacent a second, or right, side thereof, and the ribbon cable 14 extends out of the connector 32 from the first, or left, side thereof. Thus, the terminated edge indicator 170*b* can indicate to a user a position of a cut edge of an installed ribbon cable 14 (e.g., along the second side 142) and/or a direction of ribbon travel (e.g., toward the first side 140). Alternatively, as shown in FIG. 6, the upper surface 148 can include a horizontal line 170*a* that extends across the upper surface 148 to the first side 140, but stops short of the second side 142, indicating that ribbon travel does not extend past the second side 142.

Accordingly, in some embodiments, the only difference between the covers 48 of the power tap left connector 30 and the power tap right connector 32 may be the extended edge 150 along the first or second side 140, 142, and a placement of the features 170. However, in some embodiments, the cover 48 may be manufactured without such components. For example, the cover 48 may not include the components, or the components can be applied to the cover 48 after manufacture based on its use with a desired connector. As such, in some embodiments, a universal cover 48 can be manufactured, applicable or adaptable to any type of connector within the network.

Referring now to FIGS. 6, 9, and 10, a node connector 34, according to some embodiments, is illustrated. The node connector 34 can include a housing 40, a protection cap 42, a printed circuit board 44, a cable organizer 46, and a cover 48. However, unlike the power tap connectors 30, 32, which include one side 62, 64 accommodating a cut end of a ribbon cable 14, in the node connector 34, the ribbon cable extends out of the connector 34 from both sides 62, 64.

As such, with respect to the housing 40, while the first latch extension 84 can remain positioned along the second end 68 of the housing 40, like the power tap connectors 30, 32, both sides 62, 64 of the housing 40 can include an inverse ribbon profile 82. Additionally, in some embodiments, a lower section 58 of the housing 40 of the node connector 34 can be similar in shape, but smaller than the lower section 58 of the power tap connectors 30, 32. More specifically, the lower section 58 of the housing 40 of the node connector 34 can be sized to correspond to a node jack of a device node so that the housing 40 can be plugged into the node jack, thus physically and electrically coupling the ribbon cable 14 to the device node via the node connector 34. As a result, the protection cap 42 of the node connector 34 can also be smaller than the protection cap of the power tap connectors 30, 32 in order to fit to the lower section 58 of the housing 40. However, in some embodiments, the lower section 58 and protection cap 42 can be identical to the lower section 58 and protection cap 42, respectively, of the power tap connectors 30, 32, for example, depending on a size of the node jack. Furthermore, in some embodiments, the protection cap 42 can be in the form of a protection cap jack, containing circuitry and incorporating electrical contact pins which mate to the connector socket receptacle 100 in a fashion similar to how a device (in this example, a node device) would mate with the connector socket receptacle 100. Accordingly, should the connector 34 be removed from a device, for example in the event of device repair or replacement, the protection cap jack could replace the device either temporarily or permanently, thereby maintaining the data transmission and signal integrity along the ribbon cable data conductors 22.

Furthermore, in some embodiments, the printed circuit board 44 can include conductor contacts 52 in different relative locations than those of the power tap connectors 30, 32 so as to engage different conductors 22 of the ribbon cable. However, in other embodiments, the printed circuit board 44 can include conductor contacts 52 in the same relative locations as those of the power tap connectors 30, 32 so as to engage the same conductors 22 of the ribbon cable 14. Furthermore, as shown in FIG. 10, the printed circuit board 44 can further include a connector socket receptacle 100 sized and adapted to plug into a corresponding node jack on a node device to electrically and physically connect the ribbon cable 14 to the node device when the lower section 58 of the housing 40 is plugged into the node jack.

Additionally, as shown in FIGS. 9 and 10, the cable organizer 46 of the node connector 34 can be identical to the cable organizer 46 of the power tap connectors 30, 32 (e.g., a universal cable organizer 46). However, in other embodiments, the cable organizer 46 can include apertures 124 specific only to the node connector 34, that is, specific to the locations of the conductor contacts 52 on the printed circuit board 44.

Still referring to FIGS. 6, 9, and 10 and the node connector 34, the cover 48 can include the latch 160 positioned along the second end 146 thereof, like the power tap connectors 30, 32. However, the cover 48 may not include an extended edge 150 on either side 140, 142. Furthermore, the upper surface 148 of the cover 48 can include one or more features 170, such as a horizontal line 170*a* that extends across the upper surface 148. In some embodiments, the horizontal line 170*a* can extend entirely across the upper surface 148 from the first side 140 to the second side 142, indicating that a ribbon cable 14 can extend out from both sides 140, 142 of the cover 48.

Accordingly, in some embodiments, the only difference between the covers 48 of the power tap connectors 30, 32 and the node connector 34 may be the extended edge 150 along the first or second side 140, 142, and a placement of the features 170. However, as discussed above, in some embodiments, the cover 48 may be a universal cover manufactured without such components. For example, the cover 48 may not include the components, and the features 170 can be applied to the upper surface 148 post-manufacture for use with the node connector 34.

Additionally, as shown in FIG. 9, in some embodiments, the node connector 34 can incorporate a cutter 180. In some embodiments, the cutter 180 can be configured to sever a specific cable conductor 22 (such as a "Select Line" of the ribbon cable 14 of some embodiments) which is dedicated to locate the relative position of a device on the ribbon cable 14, thereby enabling "nodal geography." For example, first and second conductor contacts 52 can be positioned on either side of the severed portion of the ribbon cable 14 to make electrical connection to the conductor 22 (such as the Select Line). The other end of the first conductor contact 52 (opposite the end making the electrical connection to the conductor 22) connects to a certain position of the connector socket receptacle 100, to a mating pin on a device printed circuit board assembly (PCBA), to electronic circuitry within the device PCBA, back to another mating pin on the device PCBA, back to another certain position of the connector socket receptacle 100, and back to the other end of the second conductor contact 52, thereby establishing a connection loop which bypasses the severed portion and locates the position of the device on the ribbon cable 14. Furthermore, in some embodiments, the cutter 180 can be configured to sever other cable conductors 22, such as two cable conductors 22 of a Single Pair Ethernet (SPE) bus (that is, SPE+ and SPE−). Electrical contacts on either side of the severed portions can connect to in-line (e.g., series) inductors on the printed circuit board 44 to offset added capacitance created by the node and maintain signal integrity.

Referring now to FIG. 11, a terminator 36, according to some embodiments, is illustrated. The terminator 36 can include a housing 40, a cable organizer 46, and a cover 48. Like the power tap connectors 30, 32, the terminator 36 can include one side 62, 64 accommodating a cut end of a ribbon cable 14. However, unlike the power tap connectors 30, 32 and the node connector 34, the terminator 36 is not adapted to electrically or physically couple the ribbon cable 14 to a device in the network 10. Thus, the terminator 36 may not require certain features to accomplish this coupling.

For example, in some embodiments, the housing 40 of the terminator 36 can be substantially identical to the upper section 56 of the housing 40 of the power tap right connector 32 (e.g., including a similar width, length, and/or height as the upper section 56). That is, rather than including a lower section 58 defining an open bottom 60, the terminator 36 can include a rectangular housing with a closed bottom (e.g., the bottom seat 98 extends entirely across the bottom of the housing 40). Additionally, in some embodiments, the housing 40 of the terminator 36 can include one or more loop holes 182, for example, on either end 66, 68. For example, the loop holes 182 can be sized to receive cable ties (not shown). As a result, the loop holes 182 and corresponding cable ties can be used to secure the terminator 36 physically to a convenient fixed portion of an electrical control cabinet or a device within the cabinet, for example, instead of the terminator 36 being unsupported and "hanging" in free space.

Additionally, as shown in FIG. 11, the cable organizer 46 of the terminator 36 can be identical to the cable organizer 46 of the power tap connectors 30, 32 and/or the node connector 34 (e.g., a universal cable organizer 46). However, in other embodiments, the cable organizer 46 can be specific only to the terminator 36, for example, without any apertures.

Also, the cover 48 of the terminator 36 can be identical to the cover 48 of the power tap right connector 32. Accordingly, when installed on the terminator 36, a cut end of a ribbon cable 14 is adjacent a second, or right, side thereof, and the ribbon cable 14 extends out of the terminator 36 from the first, or left, side thereof. That is, while no conductors 22 of the ribbon cable 14 are selectively severed by the terminator 36, the cut end of the ribbon cable 14 can be covered by the second side 64 of the housing 40, with the cover 48 providing a visual indication of such termination.

Referring now to FIG. 12, a splicer 38, according to some embodiments, is illustrated. The splicer 38 can include a housing 40, a printed circuit board 44, two cable organizers 46, and two covers 48. Like the power tap connectors 30, 32 and the terminator 36, the splicer 38 can accommodating cut ends of ribbon cables 14. Furthermore, unlike the power tap connectors 30, 32 and the node connector 34, splicer 38 is not adapted to electrically or physically couple the ribbon cable 14 to a device in the network 10. Thus, the splicer 38 may not require certain features to accomplish this coupling.

For example, in some embodiments, the housing 40 of the splicer can be substantially identical to upper sections 56 of the housings 40 of the power tap left connector 30 and the power tap right connector 32, coupled together side-by-side (e.g., equal in width and height as the connectors 30, 32, but at least double the length). Thus, a first side 62 of the housing can include an inverse ribbon profile 82, like the power tap right connector 32, to receive a first ribbon cable 14, a second side 64 of the housing 40 can include an inverse ribbon profile 82, like the power tap left connector 30, to receive a second ribbon cable 14, and a central raised edge 184 can extend through a center of the housing 40, similar in function to the raised edge profile sides of power tap connectors 30, 32, to cover cut ends of the first and second ribbon cables 14. The central raised edge 184 can be a separate component coupled to the housing 40, or can be integral with the housing in some embodiments.

Additionally, rather than the housing 40 including lower sections 58 defining open bottoms 60, the splicer 38 can include a rectangular housing with a closed bottom (e.g., the bottom seat 98 extends entirely across the bottom of the housing 40). Furthermore, in some embodiments, the housing 40 of the splicer 38 can include one or more loop holes 182, for example, on either end 66, 68. For example, the loop holes 182 can be sized to receive cable ties (not shown).

In some embodiments, the central raise edge 184 does not extend through an entire depth of the housing 40, so that the interior space 96 can be defined within the housing 40, extending from the first side 62 to the second side 64 thereof. The splicer 38 can include a printed circuit board 44 that generally extends across the interior space 96, with two sets of conductor contacts 52 configured to contact individual conductors of the first and second ribbon cables 14, respectively. The printed circuit board 44 can further include traces that electrically couple the conductors of the first and second ribbon cables 14 together via the two sets of conductor contacts 52.

Additionally, as shown in FIG. 12, the splicer 38 can include two side-by-side cable organizers 46, for example, each identical to the cable organizer 46 of the power tap connectors 30, 32, the node connector 34, and/or the terminator 36 (e.g., a universal cable organizer 46). However, in other embodiments, the cable organizers 46 can be specific only to the splicer 38. Furthermore, as no electrical connections need to be made at to an external device, the interior space 96 of the housing 40 can accommodate the cable organizers 46 and a printed circuit board 44 without a socket receptacle.

Also, the splicer 38 can include two covers 48, substantially identical to the covers 48 of the power tap left connector 30 and the power tap right connector 32, positioned side-by-side to engage a respective latch 160 and cable organizer 46 on either side of the housing 40. That is, the housing 40 includes two latch assemblies to accommodate individual movement of two separate covers 48. Accordingly, when installed on the splicer 38, a cut end of a first ribbon cable 14 is adjacent the central raised edge 184 and extends out of the splicer 38 from the first, or left, side thereof, and a cut end of a second ribbon cable 14 is adjacent the central raised edge 184 and extends out of the splicer 38 from the second, or right, side thereof. In light of the above description, while the splicer 38 can include a larger housing 40 than the other connectors 30-36, the splicer 38 can still incorporate the same covers 48 and/or cable organizers 46.

As all connectors 30-38 described above can include similar parts, such as similar covers 48 and/or housings 40, a ribbon cable 14 can be installed on any connector 30-38 using substantially the same method and/or the same tooling. For example, in some embodiments, a ribbon cable 14 can be installed on a desired connector 30-38 using traditional tooling, such as conventional pliers. However, in other embodiments, specialty tooling specific to the connector 30-38 may be used.

Thus, according to some embodiments, the following method can be executed to install a ribbon cable 14 on a connector 30-38. First, while the connector 30-38 is in the preassembled state, the cover 48 can be translated and/or rotated away from the housing 40 to create a cable access pathway 186, for example, as shown in FIGS. 2, 7, 9, 11, and 12. In some embodiments, the cover 48 can be rotated away from the housing 40 by engaging the latch 160 with the first latch extension 84 of the housing 40.

The ribbon cable 14 can then be inserted and positioned, via the cable access pathway 186, onto the cable organizer 46 so that the ribbon profile 28 of the ribbon cable 14 conforms to and aligns with the inverse ribbon profile 122 of the cable organizer 46, as shown in FIG. 4. For example, the ribbon cable 14 can be inserted on the cable organizer 46 so that the respective strips 128 on the cable organizer 46 and the ribbon cable 14 can be aligned. In addition, in some embodiments, with respect to the power tap connectors 30, 32, the terminator 36, and/or the splicer 38, a cut end of the ribbon cable 14 can be aligned adjacent the raised profile of a respective side edge 70, 72 or central raised edge 184.

Once the ribbon cable 14 is aligned, the cover 48 can be rotated back toward the housing 40 so that it is aligned over the open top 50 of the housing 40. In some embodiments, the cover 48 can be rotated back toward the housing 40 by engaging the latch 160 with the second latch extension 116 of the cable organizer 46.

Once the cover 48 is positioned vertically above the cable organizer 46, the cover 48 can be pressed toward the housing 40 to entrap the ribbon cable 14 within the housing 40 between the cover 48 and the cable organizer 46. For example, a tool, such as a pliers, can then engage the upper surface 148 of the cover 48 and a lower surface of the connector 30-38. The lower surface can be, for example, the lower surface of the housing 40 (e.g., the lower section 58 of the housing 40 of the power tap connectors 30, 32 or the node connector 34, or the enclosed bottom seat 98 of the terminator 36 or the splicer 38). In some embodiments, to protect the open bottom 60 of the power tap connectors 30, 32 and the node connector 34, the protection cap 42 can first be placed over the lower section 58 of the housing 40 so that the tool can instead engage the protection cap 42.

Figure 13:
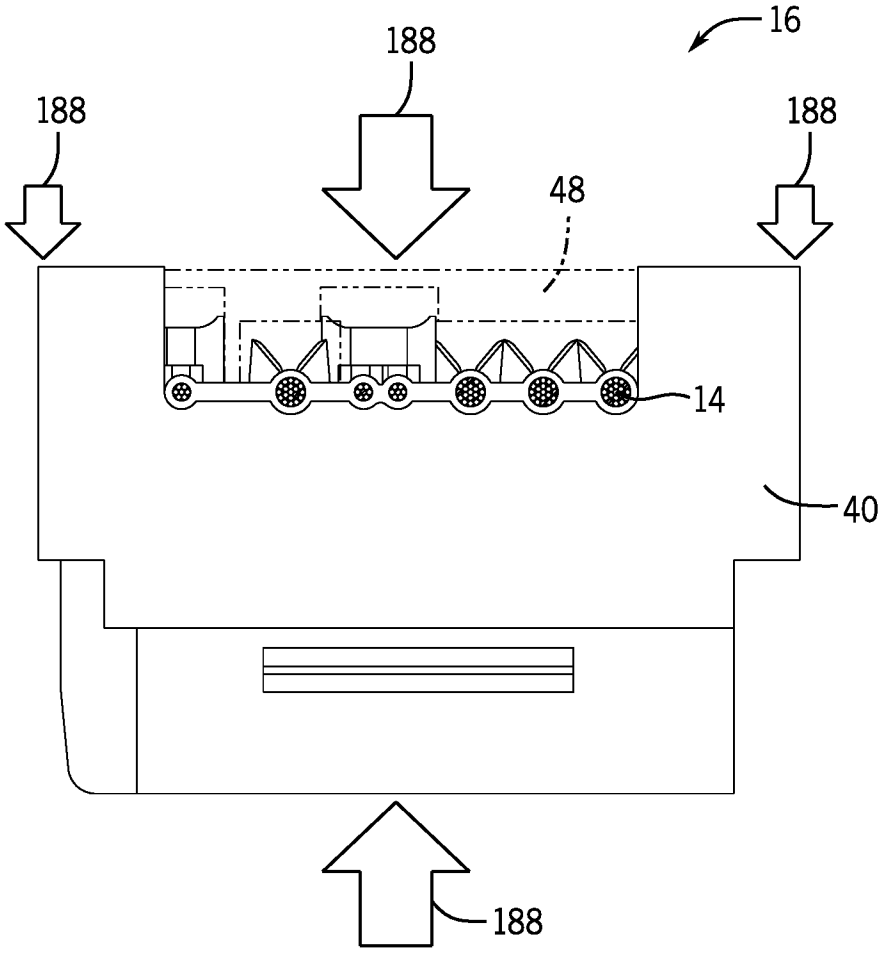
FIG. 13 is a side view of a connector in an assembled state, according to some embodiments.

Once engaged, the tool can be actuated to press the cover 48 toward the housing 40, as shown by arrows 188 in FIG. 13. The tool can press the cover 48 toward the housing 40 with enough force to disengage the lower detents 112 of the cable organizer 46 from the upper slots 136 of the housing 40, moving the cable organizer 46 downward until the lower detents 112 snap into the lower slots 138 of the housing 40 and the upper detents 114 engage the notches 158 of the cover 48 (e.g., by snapping onto the shoulders 168). In some embodiments, at the end of this movement, the compression forces (indicated by the arrows 188 in FIG. 13) can be distributed fully onto the housing 40 (e.g., due to the extended edges 150 of the cover engaging respective edges 70, 72, 74, and/or 76 of the housing. This clamping further completes termination of each conductor contact 52 onto the ribbon cable 14, thus electrically coupling the conductors 22 to the socket receptacle 100 in the power tap and node connectors 30, 32, 34, and coupling the conductors 22 of adjacent ribbon cables 14 together in the splicer 38.

In the preceding specification, various embodiments have been described with reference to the accompanying drawings. It will, however, be evident that various modifications and changes may be made thereto, and additional embodiments may be implemented, without departing from the broader scope of the invention as set forth in the claims that follow. The specification and drawings are accordingly to be regarded in an illustrative rather than restrictive sense.

What is claimed is:

1. A connector for receiving a ribbon cable, the connector comprising:

a housing including an open top and a first latch extension along a first end thereof, extending in a first direction between two first notches;

a cable organizer including a second latch extension along a first end thereof, extending in a second direction, perpendicular to the first direction, between two second notches, the cable organizer configured to be positioned within an interior of the housing in a preassembled position so that an outer edge of the first latch extension is adjacent to an outer edge of the second latch extension and the two first notches and the two second notches are aligned; and a cover configured to selectively cover the open top of the housing to enclose the cable organizer within the interior of the housing, the cover including a latch configured to engage the first latch extension and the second latch extension to both translate in a vertical direction relative to the housing and rotate relative the housing.

2. The connector of claim 1, wherein the cover is configured to rotate relative to the housing about a moving axis dependent on a vertical position of the cover relative to the housing.

3. The connector of claim 1, wherein the cable organizer is further configured to be positioned within the interior of the housing in an assembled position so that the outer edge of the second latch extension is positioned below the first latch extension and the two second notches align with a solid surface of the housing to substantially prevent rotational movement of the cover relative to the housing.

4. The connector of claim 3 and further comprising a plurality of conductor contacts housed within the housing and configured to engage individual conductors of the ribbon cable.

5. The connector of claim 4, wherein the cable organizer includes a top surface configured to receive the ribbon cable and a plurality of apertures aligned with the plurality of conductor contacts to permit the plurality of conductor contacts to extend through the cable organizer to engage the individual conductors of the ribbon cable.

6. The connector of claim 5, wherein vertical movement of the cover toward to the housing forces the cable organizer further into the housing toward the assembled position to cause the plurality of conductor contacts to extend through the cable organizer to engage the individual conductors of the ribbon cable.

7. The connector of claim 6, wherein the cover is configured to be moved toward the housing by a tool that engages an upper surface of the cover and a lower surface of the housing and is actuated to force the cover toward the housing.

8. The connector of claim 7 and further comprising a protection cap configured to cover a lower surface of the housing to be positioned between the lower surface of the housing and the tool.

9. The connector of claim 1, wherein the latch includes spaced-apart extensions that extend downward from an end of the cover and a bar connected between lower ends of the extensions to define an open slot between the end of the cover, the extensions, and the bar.

10. The connector of claim 9, wherein the first latch extension and the second latch extension are sized to fit through the open slot to engage the latch.

11. The connector of claim 10, wherein the cable organizer is configured to be positioned within the interior of the housing in the preassembled position so that the outer edge of the first latch extension is spaced relative to the outer edge of the second latch extension to prevent the latch from being disengaged from both of the first latch extension and the second latch extension.

12. The connector of claim 10, wherein the extensions are sized to move within the two first notches and the two second notches to achieve the translational and rotational movement of the cover relative to the housing.

13. A connector for receiving a ribbon cable, the connector comprising:

a housing including an open top and a first latch extension along a first end of the housing, extending in a first direction between two first notches;

a cable organizer configured to be positioned within an interior of the housing and configured to receive the ribbon cable upon an upper surface thereof, the cable organizer including a second latch extension along a first end thereof, extending in a second direction, perpendicular to the first direction, between two second notches, the cable organizer configured to be positioned within an interior of the housing in a preassembled position so that an outer edge of the first latch extension is adjacent to an outer edge of the second latch extension and the two first notches and the two second notches are aligned; and a cover configured to selectively cover the open top of the housing to enclose the cable organizer within the interior of the housing, the cover coupled to the housing and including a latch configured to engage the housing and the cable organizer and move in a both vertical direction relative to the housing and rotate relative to the housing;

wherein the latch is configured to engage the first latch extension and the second latch extension to enable vertical translation and movement of the cover relative to the housing.

14. The connector of claim 13, wherein the latch includes spaced-apart extensions that extend downward from an end of the cover and a bar connected between lower ends of the extensions to define an open slot between the end of the cover, the extensions, and the bar; and the first latch extension and the second latch extension are sized to fit through the open slot to engage the latch.

* * * * *